US006141936A

United States Patent [19]

Butler, Jr.

[11] Patent Number: 6,141,936

[45] Date of Patent: Nov. 7, 2000

[54] PREFABRICATED CONCRETE FOOTINGS

[76] Inventor: Robert P. Butler, Jr., 404-C Commerce St., Charlottesville, Va. 22902

[21] Appl. No.: 07/908,967

[22] Filed: Jul. 6, 1992

Related U.S. Application Data

[63] Continuation-in-part of application No. 07/406,734, Sep. 12, 1989, abandoned.

[51] Int. Cl.[7] ..... E02D 27/00

[52] U.S. Cl. ..... 52/741.11; 52/169.9; 52/294; 52/295; 52/296; 52/299; 52/608; 52/741.15; 52/742.14; 52/745.2

[58] Field of Search ..... 52/294, 295, 296, 52/297, 169.9, 166, 309.15, 309.17, 299, 608, 741.11, 741.15, 742.14, 745.2

[56] References Cited

U.S. PATENT DOCUMENTS

| | | | |
|---|---|---|---|
| 820,318 | 5/1906 | Schwem | 52/297 |
| 1,433,621 | 10/1922 | Hutton | 52/166 |
| 1,711,178 | 4/1929 | Sague | 52/297 |
| 1,958,889 | 5/1934 | Fish | 52/297 |
| 2,620,137 | 12/1952 | Gilmer | 52/166 |
| 3,108,403 | 10/1963 | Jackson | 52/169.9 |
| 3,276,176 | 10/1966 | Jonsson et al. | 52/309.17 X |
| 3,572,223 | 3/1971 | Vierregger | 52/296 |
| 3,593,480 | 7/1971 | Bouchillon | 52/309.17 X |
| 3,802,139 | 4/1974 | Eischen et al. | 52/297 |
| 3,890,751 | 6/1975 | Caputo et al. | 52/296 X |
| 4,068,445 | 1/1978 | Bobbitt | 52/296 |
| 4,899,497 | 2/1990 | Madl, Jr. | 52/299 |
| 4,918,891 | 4/1990 | Gerszewski | 52/295 |
| 5,163,967 | 11/1992 | Hoffman et al. | 52/297 |

FOREIGN PATENT DOCUMENTS

| | | | |
|---|---|---|---|
| 658564 | 5/1965 | Belgium | 52/299 |
| 334240 | 10/1903 | France | 52/299 |
| 309310 | 7/1933 | Italy | 52/299 |

*Primary Examiner*—Christopher T. Kent
*Attorney, Agent, or Firm*—Sheldon H. Parker

[57] ABSTRACT

The construction system can be achieved through the use of a novel prefabricated construction footing. The footing, can have a circular or rectangular top, and a circular base. The sides are downwardly tapered thereby forming a conical shape. If the shape is viewed as a cone or pyramid, then the top portion is truncated thereby forming a frustrum of a cone or pyramid. The top serves as a support surface for a post. The top surface can be curved thereby forming a dome like structure. The dimensions of the footing are such that the ratio of the surface area of the top to the bottom, is on the order of from about 1:1.3 to about 1:8.3. The top surface is substantially parallel to the bottom surface and the angle between the side surface and a line perpendicular to the top surface is at least about 20 degrees. That is, the footing is conical or pyramidal in shape, with a truncated top. The height of the footing is from about three to about six inches and the ratio of the square root of the surface area of the bottom surface is on the order of from about 1:2 to about 1:5.

9 Claims, 3 Drawing Sheets

PREFABRICATED CONCRETE FOOTINGS

BACKGROUND OF THE INVENTION

This application is a continuation-in-part of U.S. Application Ser. No. 07/406,734, filed Sep. 12, 1989, now abandoned the subject matter of which is incorporated by reference as though recited in full herein.

FIELD OF THE INVENTION

The instant disclosure relates to prefabricated lightweight concrete footings for decks and light construction products up to one story structures. The footings are manufactured from a lightweight concrete composition and manufactured in either cylindrical or frustrum shape. The factory production of the product allows for substantial savings on concrete usage.

BRIEF DESCRIPTION OF THE PRIOR ART

Lightweight concrete compositions per se are known in the art. Frequently this type of product is produced by formulating a concrete mix with lightweight aggregate materials which have been employed in the prior art to produce lightweight concretes are expanded shale, pumice, volcanic tuffs, sintered diatomite, blast furnace slag, sintered fly ash, perlite and vermiculite.

U.S. Pat. No. 4,268,317, to Rayl, discloses a lightweight, structurally strong material which can be used in place of standard concrete. The material disclosed therein has a bulk density of about 72 pounds per cubic foot and a air cure compressive strength of about 3400 psi. The Rayl patent combines various aggregates in low density and very high amorphous $SiO_2$ content to provide a product which is of equal strength and one half the weight of standard concrete. The Rayl material is poured, shaken, dewatered and kiln dried.

Concrete is a mixture of cement, water and aggregates, the proportions of which affect the strength, workability and general structural integrity of the concrete. The weight of standard concrete is approximately 150 pounds per cubic foot. The mixing of concrete must be done on the day of pouring as over mixing once homogeneity is reached can be detrimental to the slump, placement and strength. Addition of water to bring the slump back to original consistency reduces the strength. The molding of the concrete is important and concrete should be placed in the form in such a way to prevent deficiencies commonly known as bug holes or honeycomb. The molds must be level and retained in a vertical position. The calculations of the quantity of concrete are done based on estimated over usage and any excess is then disposed of. The disposal of excess concrete presents an ecological problem and excess concrete is difficult to reuse.

SUMMARY OF THE INVENTION

It has now been found that an improved construction system can be achieved through the use of a novel prefabricated construction footing. The footing, can have a circular or rectangular top, and a circular base. The sides are downwardly tapered thereby forming a conical shape. If the shape is viewed as a cone or pyramid, then the top portion is truncated thereby forming a frustrum of a cone or pyramid. The top serves as a support surface for a post.

In a preferred embodiment, the footing has a substantial hollow interior in order to provide for light weight. Since the primary load bearing is carried by the exterior region, the hollow interior has a greater impact on weight than on load bearing capacity. That is, the load distribution is such that a substantial decrease in weight can be achieved without experiencing a corresponding decrease in load bearing capacity.

The top surface can be curved thereby forming a dome like structure. This not only provides for better water drainage, but also cooperates with the load stress distribution. The footing can be provided with a load bearing structural support between the dome like top structure and the interior surface of the base. The load bearing support can be a concrete beam extending normal to the base. The footing side walls of the hollow dome embodiment preferably which radially inward progressively from a region proximate the top to the base. Thus, the walls in the region of the ground contacting bottom surface is thicker than the upper region.

The prefabricated footing can have its hollow interior at least partially filled with light weight waste material. This not only provides for a disposal mechanism for waste products, but also uses waste product to add structural strength.

The dimensions of the footing are such that the ratio of the surface area of the top to the bottom, is on the order of from about 1:1.3 to about 1:8.3. The top surface is substantially parallel to the bottom surface and the angle between the side surface and a line perpendicular to the top surface is at least about 20 degrees. That is, the footing is conical or pyramidal in shape, with a truncated top. The footing can be of any polygonal shape from three sided to circular (a circle being a polygon of infinite sides). The height of the footing is from about three to about six inches and the ratio of the square root of the surface area of the bottom surface is on the order of from about 1:2 to about 1:5. In a preferred configuration, the top surface is square and the bottom surface is circular. Obviously, the shape is achievable with prefabricated footings but could not reasonably be expected to be attainable in on site manufactured footings. The novel configuration accommodates rectangular posts and provides the optimum use of material.

Attachment of the footing to a post can be accommodated through the use of at least one bolt. A bolt pathway can be provided which extends through the footing between the top and the base and is centered within the circular top.

The post is normally centered within the circular or rectangular top surface.

The material of manufacture is preferably lightweight concrete, having a weight of approximately 125 pounds, or less, per cubic foot.

The prefabricated footing is installed by (a) digging a hole, (b) leveling the bottom of the hole, (c) placing the prefabricated footing in the hole, the substantially larger base being in contact with said bottom of the hole, (d) tamping the footing, (e) affixing a support post to the top of the footing; and (f) refilling the hole with soil by placing soil above and around the footing.

The footing can be formed in a plastic mold which forms an integral protective cover for the footing. The cost of the protective member is offset by the eliminating the need for conventional molds and provided for rapid manufacture of large numbers of footings. Further, the need to remove the footing form the mold is eliminated thus making it practical to let the footing set in the mold for the maximum required period of time. It is preferred to subject the footing to vacuum water removal subsequent to pouring and prior to setting.

DETAILED DESCRIPTION OF THE INVENTION

Figure 1:
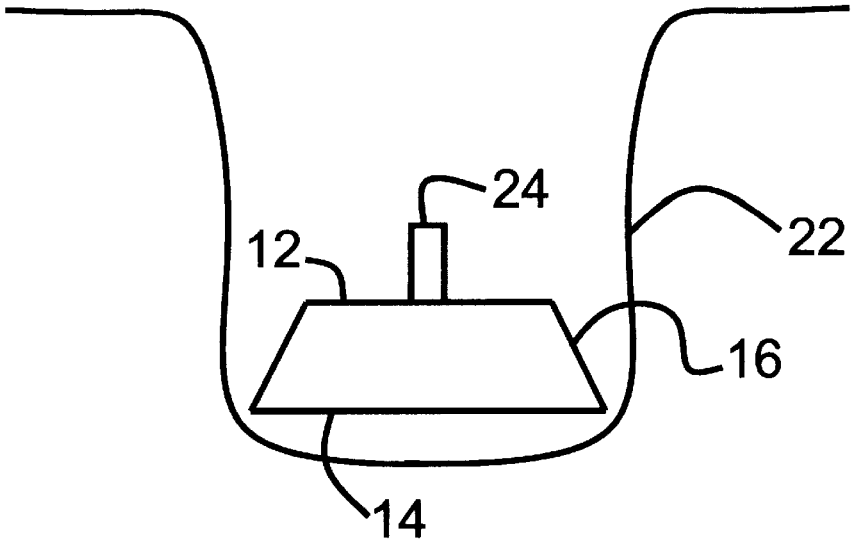
FIG. 1 shows a frustroconical footing of the present invention positioned in a hole.

FIG. 1 illustrates the frustroconical footing 10 positioned in the hole 22; however they can be used above ground as well. The average sizes of the instant footings easily fit into a hole dug by a standard tractor auger, allowing for use of rapid and readily available digging equipment. The frustrum footing 10 has a top 12, a sloping vertical surface 16 and a base 14. The intersection of the vertical surface 16 with the top 12 and the base 14 is preferably rounded, however the intersection can be chamfered if preferred for manufacture. In the manufacture of the prefabricated concrete footing, weight can be critical. The shipping of excess material results in avoidable shipping expense, which is substantial due to the high weight of concrete. The consumer typically purchases the prefabricated footings in retail establishments and then must have the footings delivered to the construction site. The route for the concrete is typically, from the factory to a distributor, to a retail outlet, and then to the construction site. Frequently, the consumer is ill equipped to move the footings and thus, any weight savings represents a significant savings in shipping costs to the consumer. Weight savings can be achieved through the use of a footing design which permits for optimum flow of the concrete during its formation. This results in an optimum weight to strength ratio. The use of a conical configuration produces strength advantages over a rectangular configuration due to the improved flow pattern of the concrete during the pouring operation. Similarly, the use of chamfered edges produces further optimization of the weight to strength ratio. The load bearing characteristics of the footing is such that, in a rectangular block, the region of the block which is outward of the imaginary line from the periphery of the post to the periphery of the base of the rectangular block provides little, if any contribution to the strength, or load bearing ability of the block. Thus, the use of tapered sides, or a frustroconcial configuration, serves to optimize the weight to strength ratio of the footing.

Figure 2:
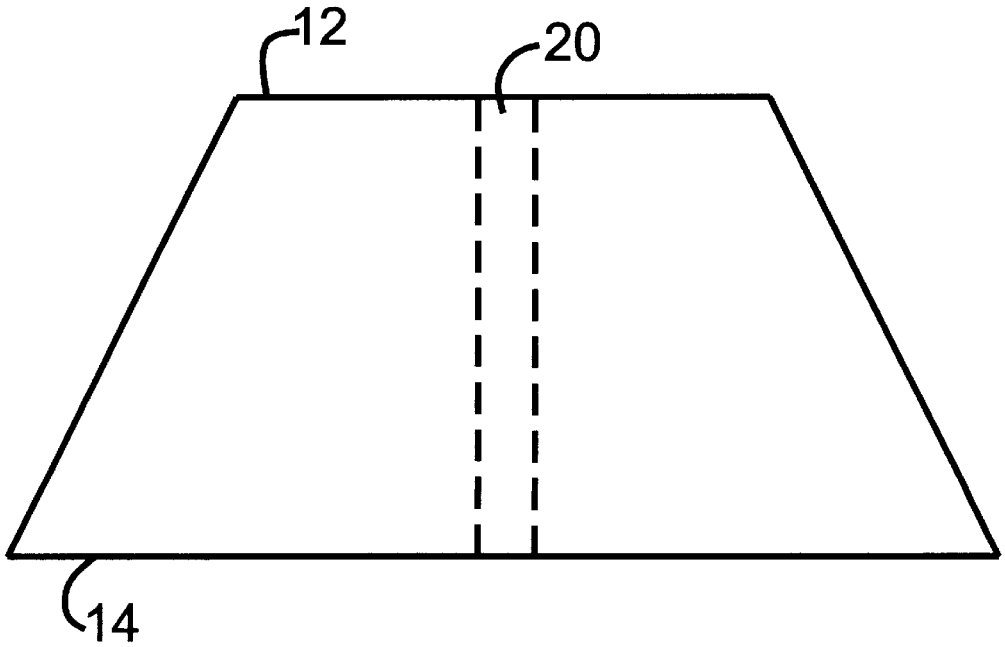
FIG. 2 shows a cutaway view of a footing of the present invention.

The attachment bolt 24 extends from the top 12 of the frustrum footing 10 for anchoring the wooden studs to the frustrum footing 10. In FIG. 2, the frustrum footing 10 is cutaway to show the bolt pathway 20 through the center. It should be noted that although only one pathway is illustrated in FIG. 2, multiple pathways can be incorporated at time of manufacture. Additional pathways, providing multiple bolt connections, would be used to attach metal plates, off center studs, etc. The bolt 24 must be of sufficient length to extend beyond the top 12 of the frustrum footing 10 to allow for attachment of the stud. The bolt pathway 20 also allows for water drainage, whether or not the bolt 24 is utilized. The preferred attachment bolt 24 would be a conventional lag bolt or lag screw. The bolt pathway 20 to allow for passage for the lag bolt provides substantial savings for the user. The lag bolt is substantially less expensive than any ex post facto and can be purchased at most stores.

Previously, attaching a stud to a concrete footing has created problems. By pouring concrete on site directly into a mold it is extremely difficult to place any type of securing device into the concrete accurately. Due to this difficulty, the studs are secured to the concrete after the concrete is poured and hardened. Inherent in this method also has a certain inaccuracy due to the unlikelihood of both the concrete and end of the stud being perfectly square. The securing means can be through nails shot through the stud into the concrete with a powder actuated gun or use of a post base metal plate, which allows for a more exact placement of the stud. In order for concrete poured on site to be properly cured, it should be left to harden for 28 days before any weight is attached to it. Generally, due to time pressures, studs are attached to the concrete prior to the 28 day period, before the optimum strength level is reached. Concrete is in a placid state for at least three days, depending upon weather conditions. Once all water has left the concrete, the curing process starts and the concrete slowly gains strength over the 28 day period. Placing of weight on the footing while it is in the curing process causes premature stress. The footings of the instant disclosure are left to cure in the manufacturing plant for at least 30 days prior to shipment. This allows the user to install the instant footings and immediately proceed with building. The combination of precured footings, the ease of stud attachment through use of a lag bolt, and the lack of need for specialized digging equipment make the instant footings economically advantageous over on-site footers.

Figure 3:
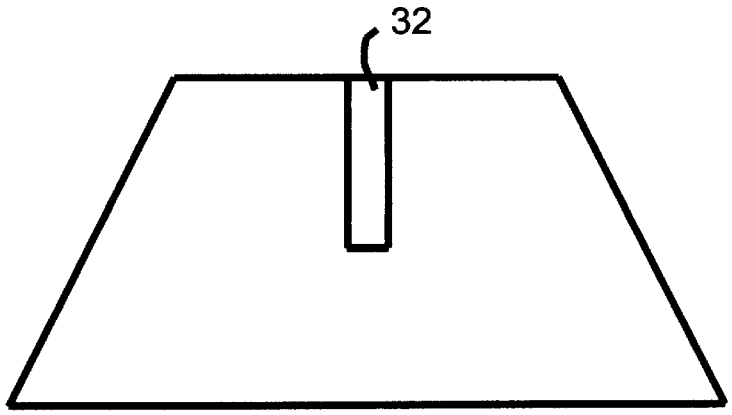
FIG. 3 shows an alternate embodiment of the invention.

FIG. 3 is an alternate embodiment wherein the bolt passage 32 is partially cut through the frustrum footing 30. In this embodiment an ex post facto bolt can be used in the partial passage 32 instead of a standard pass through, lag, screw or carriage bolt. The plugged section of the frustrum footing 30 can be knocked out in the field, in the event a standard bolt is desired.

Figure 4:
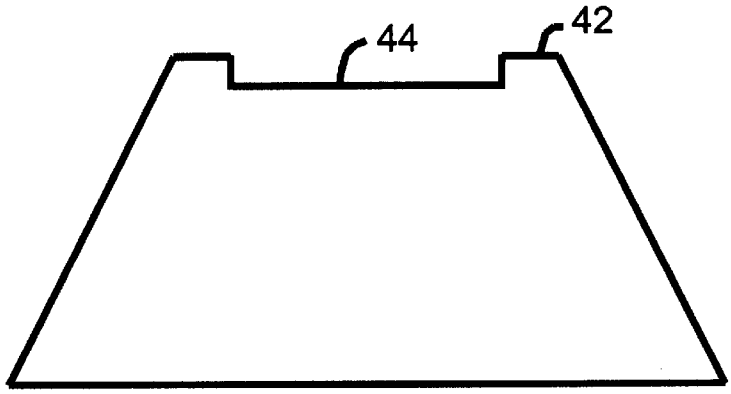
FIG. 4 shows a frustrum footing having a post receiving portion.
Figure 5:
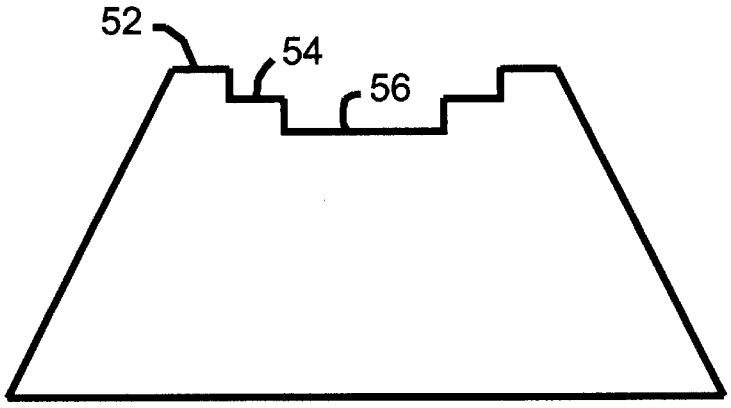
FIG. 5 shows an alternate embodiment of the invention of FIG. 4.
Figure 6:
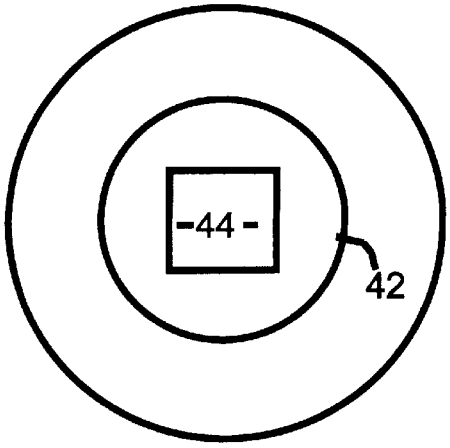
FIG. 6 is a top view of the invention of FIG. 4.

In FIG. 4 a post receiving portion 44 is provided to receive a single sized post. The post receiving portion 44 is placed in the center of the top 42 of the frustrum footing 40. The post is placed within the post receiving portion 44 and secured through the optional use of a bolt (not shown). The frustrum footing 40 can be provided with either the full bolt passage 20 of FIG. 2 or the partial passage 32 of FIG. 3. A top view of the frustrum footing 40 is illustrated in FIG. 6 with the post receiving portion 44 centered within the top 42. An alternate embodiment is shown in FIG. 5 wherein the post receiving portions 54 and 56 are at different levels receiving different sizes of posts in a step down manner. The post receiving portion 56 is sized for 4"×4" studs and is centered within the frustrum footing 50. The post receiving portion 54 is sized for 6"×6" studs and is also centered within the frustrum footing 50. The flat portion of the frustrum footing allows for 8"×8" post with the anchoring maintained by means as described above. The recess for the post receiving portion 56 is greater than that of the post receiving portion 54, allowing for the multiple use. The configuration of the post receiving portion 56 of the frustrum footing 50 also allows use of round studs if so desired for building purposes. The studs utilized herein are not necessarily of wood, but can be any other material which is well known in the prior art.

Figure 7:
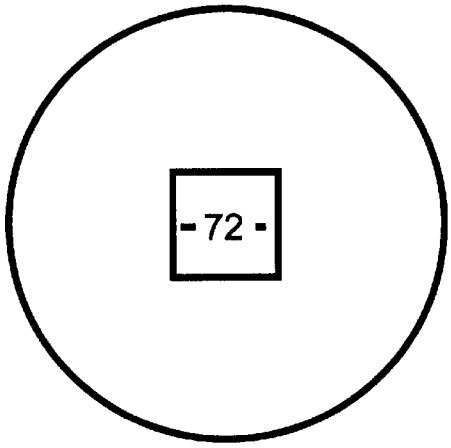
FIG. 7 is a top view of a cylindrical footing.

In FIG. 7 the footing is cylindrically shaped instead of conically tapered. The cylindrical shape provides the same support and this type of support may be required in some situations. The cylindrical shape is mostly used above ground for decorative and aesthetic purposes as well as some structural purposes and the extra materials required can be unwarranted. The extra material contributes extra weight without contributing significantly to the strength of the footing, if at all.

The post receiving area 72 is centered within the cylinder 70, as previously described in the frustrum footings. Additionally, the multiple bolt pathways can be incorporated in the cylinder 70.

Figure 8:
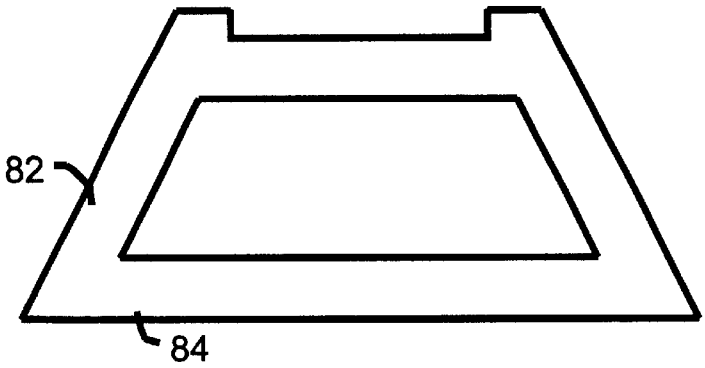
FIG. 8 shows a frustrum footing having a core.

In FIG. 8 an alternate embodiment is disclosed wherein the frustrum footing 80 is provided with a core 84 for further weight distribution. The core 84 is surrounded by the lightweight concrete 82. The core 84 must be centered within the concrete 82 for even dispersal and distribution of load and stress forces. The core 84 also assists in optimizing strength requirements between structure and soil. In the preferred construction, the concrete around the core is approximately one (1) inch to provide structural strength. The amount of concrete around the core can be reduced, however the density of the concrete must be increased for strength and reinforcement. The core 84 serves as a supporting structure until the outer layer cures. Additionally, the core 84 helps to maintain the shape of the frustrum footing 82 and adds strength, as most commonly measured by psi.. Other measurements of strength can be used, depending upon use. The core 84 should match or approximate the density of the concrete but preferably have a specific gravity of 1.6 or less to further decrease the weight without sacrificing structural integrity. Examples of materials which can be utilized for the core 84 would be styrofoam or celotex. A caisson is a type of configuration which is sometimes used in certain ground conditions where the water level is extremely high. The heavy solid concrete tends to sink into the water laden soil while a caisson tends to work in conjunction with the water to prevent the sinking. The instant footing provides the lightweightedness, however is unlike a caisson where to interior form is removed and the core is empty. The core 84 is used to provide equivalent structural strength to solid concrete while giving the footing weight closer to that of a caisson.

The frustrum footings disclosed herein are preferably formed from a lightweight concrete, but can be standard heavyweight materials depending on the circumstances of a regionalized economy. The preferred formula for the frustrum footings is:

one part cement two parts sand, fine aggregate or recyclable material such as porcelain three parts stone, rough aggregate or recyclable material water to achieve desired slump, consistency and strength other additives mixed with water such as plasticisers or water reducers to maintain or increase strength and/or lightweightedness.

Retroactive processes, such as vacuuming the water from the partially set concrete can also be used to increase strength, reduce weight and hasten curing.

There are a variety of options which can be employed with the above formula to accomplish various specialized uses. Air entrainment 1% to 16% can be used accordingly to exterior use, fluidity in placement and economy of product. Air internment increases the resistance to disintegration during exposure to freezing and thawing. In pavement, air entrainment prevents the scaling which results from ice removal chemicals. The workability of concrete is also improved through the introduction of air. An alternative to the standard methods of air entrainment would be the use of carbonated water. The carbonated water would be substituted for the mixture of plain water and air entrainment. Plasticisers, in a proportion of 1% to 16% can be used to achieve desired slump and fluidity. Carbon or forms of carbon by-products can be used for increased strength and temper. The carbon can also be used not only in addition to but as a substitute for cement, providing an economy of product. The frustrum footings and its composite mix design can be reinforced and sized to vary with demands of flexural, tensile and rigidity strengths as well as the punch shear executed by the posts. Thus reinforcement becomes more crucial in the larger sizes.

As example of a material combination for production of the lightweight concrete of the instant invention is set forth in Example I.

EXAMPLE I

Dry components

21% portland I cement

34% of ¾ inch No. 4 Solite®

45% of ⅛ inch to 0 Solite®

Wet components 99.6% water 00.3% water reducer 00.1% air entrainment

When mixed in large batch quantities, these ingredients can be mixed as follows: 565 pounds of portland I cement, 900 pounds of ¾ inch No. 4 Solite® lightweight aggregate, 1,220 pounds of ⅛ inch to 0 Solite® lightweight aggregate, 37 gallons of water, 15 ounces of water reducer and 4 ounces of air entrainment. These quantities are mixed to tolerances of about +/−5%. This mixture provides a strong 2500 psi concrete. Fiber glass reinforcement can be added when required for additional strength.

The frustrum footings disclosed herein have angles varying from just under 90 degrees to 20 degrees. The frustrum footing works as a larger object in a smaller object, or containment and can be related to a barb of a bee. The taper is placed along the natural line of shear, thereby eliminating unneeded or minimal value concrete. The downward forces which occur in footings is spread along the wider base of the frustrum footing. When soil is placed upon it by filling the cavity, the plug fits into the soil, and locked in as the latter is tamped or compressed. As an alternative, the frustrum footings can have a multi-sided top and base, such as a octagon, square, etc.

The common failure of concrete occurs through a combination of shear and normal stress. Shear strength in concrete is difficult to determine since concrete is weaker in tension than in shear. Therefore the standard "pure shear" tests are not necessarily accurate. Through use of typical Mohr rupture diagrams, it has been found that shearing strength is equal to 20% of the compressive strength of concrete.

The taper also provides an easy release system during manufacture. The molds are manufactured with the base open and positioned with the position during filling being determined by the slump. When a wet mix, or high slump, is used, the concrete formula is poured into the molds which are positioned with the top down. When a zero, or less, slump is used, the molds are inverted and the mold pressed into the concrete. The slump should be in the range from one quarter to four to provide optimum strength and setting time. The lower slump provides a shorter curing time, thereby allowing the mold to be removed sooner. The footings are then stored and allowed to fully cure prior to shipment.

The taper makes for easier stacking and shipment and contributes to compactness and lightweightedness. In order to increase the strength for heavier loads, the frustrum footings can be stacked one upon another and connected with a rod. The connection of the frustrum footings with the rod is optional. It also improves the economy of the product by using only that concrete that is absolutely necessary to structural purposes. The precasting of the frustrum footings provides the advantage of being mixed at a plant, providing the quantative and qualitative advantage of consistent conditions each time the formula is mixed. The quality control and pollution control available at a manufacturing plant far surpasses the controls available on site, allowing for stronger, more durable concrete. Additionally, the footings can be mass produced centrally, cutting the end cost to the consumer.

The frustrum footings are preferably designed with a conical configuration in order to restrict the concrete used to the primary load bearing regions of the footing configuration. Thus, it becomes possible to avoid the use of materials not absolutely necessary to the structural integrity of the product thereby improving the economy of the product. The use of the cylindrical configurations eliminates all discontinuities, which provides for greater strength and less risk of fracturing. Square formed concrete tends to be wasteful of material though it provides for ease of material calculation and placement.

As an alternative, the above disclosed material can be used for continuous footings. The continuous footing is longitudinal with a tapered or straight cross section. As no sizes can be pre-determined for a ready-to-use sale, dimensions must be determined for each situation. Continuous footings can, however, be modulized per site via the same charting process disclosed hereinafter. Although continuous footings are common enough, lightweight ones ready-to-place as a solid unit are not.

Lightweight continuous footings allow the same selection of design purposes, the same transportation and distribution advantages, and the same economy benefits.

When continuous footings are required, they frequently require locking together. Provisions for locking, or a "key's" are made at the ends for joining, cornering and stepping. These types of locking provisions are well known in the prior concrete art and can be employed with the footings of the instant disclosure.

Tapering in the same amount of degree allowance as in above is, as an option, applied to the sides of the continuous footing.

The taper design of the instant disclosure differs from pilings substantially. Pilings are used when the soil is unable to hold a standard footing. V shaped, or screw shaped, supports are pounded into undisturbed soil, thereby displacing a quantity of soil in an area equal to the piling, thus increasing the density of the soil around the piling. The soil around the pilings must be undisturbed. The frictional forces downward are in the piling. The frustrum footings, due to their tapered shape, place the dominate friction forces in the soil in a downward or compressive manner. In order to engineer a piling to hold the intended structure, knowledge of the soil conditions, ground movement of the area are critical. Pilings must be individually designed for each specific structure. The equipment used to install the pilings is also specialized and expensive. The frustrum footing of the instant disclosure provides, in most instances, the same stability while reducing costs dramatically.

In order to fully accommodate the general user, a charting system has been designed which is a pre-contained engineering package showing the uses of the plug under certain conditions, soil to structure. From this chart the layman can decide the quantity needed and placement of the plugs. The more sophisticated user, such as the engineer or architect, can quickly decide the suitability of the product to their project, or just as quickly order what he needs to be customized.

Previously an engineer would design, on a per-case basis, what footing is needed and order it. Transportation of concrete increases the possibility of consistency problems due to under or over mixing, as well as pouring problems. Because the engineer is also limited by the restrictions of the regional source of the concrete, he is also confined to work with only certain strength attributes of a infinite more variety. The centrally located manufacturing basis of the instant disclosure allows the user the flexibility, or the increased manipulation of variables in the performance of a balance between strength and economy, in a ready made form.

The first determination is the type of soil in the area where the construction is taking place; the next is the size and weight of the structure. Normally, in light construction, it is the structure that is the engineer's priority, with little or no consideration towards the soil. This instant system takes, as its priority, the soil strength which is then put in combination with structure size and weight. The footing becomes the controlled variable, whereby the choice of size and strength are fitted precisely to soil conditions and construction requirements. The ability to vary the size of the frustrum footings provides a economical versatility. The user then chooses the appropriate number and size of the instant footings without paying for sizes beyond what is required. Authorities in the industry admit that the soil is a primary consideration that has been neglected, and is only now a developing art.

The frustrum footing can also be used above ground, providing additional support over standard above ground footings. In above ground applications, the cylindrical footing will be more appropriate as the aesthetics are more complimentary to architectural design.

Concrete by nature cannot be exacting in its mix design. The current humidity and temperature; the inaccuracy of heavy machinery handling heavy, clumpy materials; uncontrollable moisture content; bulking factors, etc. all go into the mixing of concrete at the plant. Its only been in the last 10 years or so that we've had the equipment available to mix concrete within +/−2% tolerance of the desired mix design. These controls are still not practiced at most plants and, if so, are achievable only about half the time. Even with the available controls there may still a wide gap in the resulting strengths measured in psi. Various factors compromise the structural strength of concrete. Transferring the concrete from one device to another is a critical period in maintaining strength; the concrete should be allowed to fall vertically. Once placed, the concrete should not be allowed, caused to flow laterally or cold joint. Most of the pit falls which can affect the structure of the concrete are inherent to on site pouring. Most, if not all of these problems, can be avoided through in house production of the products. The load bearing strength (measured in psi.), although the most common, is only one of several strength attributes to be considered in the final product. The production of the instant footings at a central location allows for the variance of the mixing process to stress specific strength attributes. Depending upon the final use, a certain strength attribute may need to be emphasized; a process that is nearly impossible under on site conditions but obtainable under plant conditions.

The use of precast footings eliminates the modification of concrete by those carrying it in transit, or those on the job site, for convenience's sake. The quality of concrete is many times sacrificed by the placing; workers simply do not like to do it. The instant disclosure brings the unreliability of on site mixing, worker error, etc. under control. Strict quality control is easily maintained due to the in factory manufacturing providing a reliability previously unobtainable. The precast concept also provides security to both laymen and engineers that the variable factors of concrete are more tightly controlled in the finished product.

What is claimed is:

1. The method of building structures using prefabricated footings, said prefabricated footings comprising a concrete member having a substantially planar top, side and substantially planar base, said base being substantially parallel to and larger in cross-sectional area than said top to provide a downward taper configuration thereby creating a frustrum, comprising the steps of:

(a) filling a mold with concrete, (b) cure said concrete in said mold and forming a prefabricated footing, (c) transporting said prefabricated foot to a site for the construction of a building structure, (d) digging a hole, (e) leveling the bottom of said hole, (f) placing said prefabricated footing in said hole, said base being in contact with said bottom of said hole, (g) affixing a support post to said planar top of said footing, and (h) refilling said hole with soil by placing soil above and around said prefabricated footing.

2. The method of claim 1, wherein the ratio of the surface area of said top surface to said bottom surface is on the order at least about 1:1.3 to about 1:8.3 and the distance between said top surface and said bottom surface is from about 3 inches to about 6 inches.

3. The method of claim 1, wherein said top surface is substantially parallel to said bottom surface and the angle between said side surface and a line perpendicular to said bottom surface is at least about 20 degrees.

4. The method of claim 1, further comprising the steps of forming said prefabricated footing by pouring concrete into a mold, subjecting the concrete footing to vacuum water removal subsequent to pouring and prior to setting.

5. The method of claim 1, further comprising the steps of forming said prefabricated footing by pouring concrete into a mold, said mold being a plastic member which forms an integral protective cover for said footing.

6. The method of claim 1, wherein said concrete is lightweight concrete, said lightweight concrete having a weight of approximately 125 pounds, or less, per cubic foot.

7. The method of claim 1, wherein the step of affixing a support post to said top of said footing comprising the step of bolting said post to said prefabricated footing.

8. The method of claim 1, wherein said bolt has a length greater than the distance between said top and said base and an end shaped to penetrate wood.

9. The method of claim 1, wherein the ratio of the surface area of the top surface to the bottom surface is at least about 1:1.3 to about 1:8.3 and the distance between the top surface and the bottom surface is from about 3 inches to about 6 inches.

* * * * *